US007923190B2

(12) United States Patent
Magome et al.

(10) Patent No.: US 7,923,190 B2
(45) Date of Patent: Apr. 12, 2011

(54) TONER

(75) Inventors: Michihisa Magome, Mishima (JP); Tadashi Dojo, Numazu (JP); Eriko Yanase, Kawasaki (JP); Takashi Matsui, Suntou-gun (JP); Tomohisa Sano, Suntou-gun (JP); Akira Sakakibara, Susono (JP); Shuichi Hiroko, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/578,112

(22) Filed: Oct. 13, 2009

(65) Prior Publication Data

US 2010/0028795 A1 Feb. 4, 2010

Related U.S. Application Data

(63) Continuation of application No. PCT/JP2009/059941, filed on May 26, 2009.

(30) Foreign Application Priority Data

May 28, 2008 (JP) ..... 2008-139237

(51) Int. Cl.
*G03G 9/08* (2006.01)

(52) U.S. Cl. ..... 430/108.4; 430/108.8; 430/111.4

(58) Field of Classification Search ..... 430/109.3, 430/109.4, 108.8, 111.4, 108.4
See application file for complete search history.

(56) References Cited

U.S. PATENT DOCUMENTS

| | | | | |
|---|---|---|---|---|
| 2,297,691 | A * | 10/1942 | Carlson | 430/120.1 |
| 5,604,072 | A | 2/1997 | Unno et al. | 430/110 |
| 6,132,919 | A | 10/2000 | Ogawa et al. | 430/110 |
| 6,160,142 | A * | 12/2000 | Sawada et al. | 430/108.4 |
| 6,720,122 | B1 | 4/2004 | Ogawa | 430/108.4 |
| 6,899,985 | B2 * | 5/2005 | Inoue et al. | 430/108.4 |
| 7,611,814 | B2 | 11/2009 | Sensui | 430/108.4 |
| 2002/0172879 | A1 * | 11/2002 | Kada et al. | 430/108.4 |
| 2003/0190537 | A1 * | 10/2003 | Nakamura et al. | 430/108.4 |
| 2004/0072089 | A1 * | 4/2004 | Kishimoto et al. | 430/108.4 |
| 2004/0142263 | A1 * | 7/2004 | Mikuriya et al. | 430/109.4 |
| 2006/0057483 | A1 | 3/2006 | Yanase et al. | 430/108.4 |
| 2006/0073402 | A1 | 4/2006 | Sensui | 430/108.4 |
| 2007/0105033 | A1 | 5/2007 | Moribe et al. | 430/109.3 |

FOREIGN PATENT DOCUMENTS

| | | |
|---|---|---|
| JP | 11-218960 | 8/1999 |
| JP | 2000-019768 | 1/2000 |
| JP | 2001-147550 | 5/2001 |
| JP | 2002-072540 | 3/2002 |
| JP | 2002-072546 | 3/2002 |
| JP | 2002-221814 | 8/2002 |
| JP | 2004-361983 | 12/2004 |
| JP | 2006-078981 | 3/2006 |
| JP | 2006-098745 | 4/2006 |
| WO | WO 98/20396 | 5/1998 |
| WO | WO 01/01200 | 1/2001 |

OTHER PUBLICATIONS

English Langauge machine translation of JP 4106873 B (Jun. 2008).*
English language machine translation of JP 11-002922 A (Jan. 1999).*
International Preliminary Report on Patentability dated Jan. 20, 2011, in International Application No. PCT/JP2009/059941.

* cited by examiner

*Primary Examiner* — Christopher RoDee
(74) *Attorney, Agent, or Firm* — Fitzpatrick, Cella, Harper & Scinto

(57) ABSTRACT

In a toner containing at least a binder resin, a colorant, an ester compound and a low-melting material, the ester compound is an ester of dipentaerythritol with a carboxylic acid having 18 or more to 25 or less carbon atoms, and, where the melting point of the ester compound is represented by $Tm_{(A)}$ (° C.) and the melting point of the low-melting material is represented by $Tm_{(B)}$ (° C.), the toner satisfies the relationship of:

$$Tm_{(B)} \leqq Tm_{(A)} + 5.$$

8 Claims, 1 Drawing Sheet

FIGURE
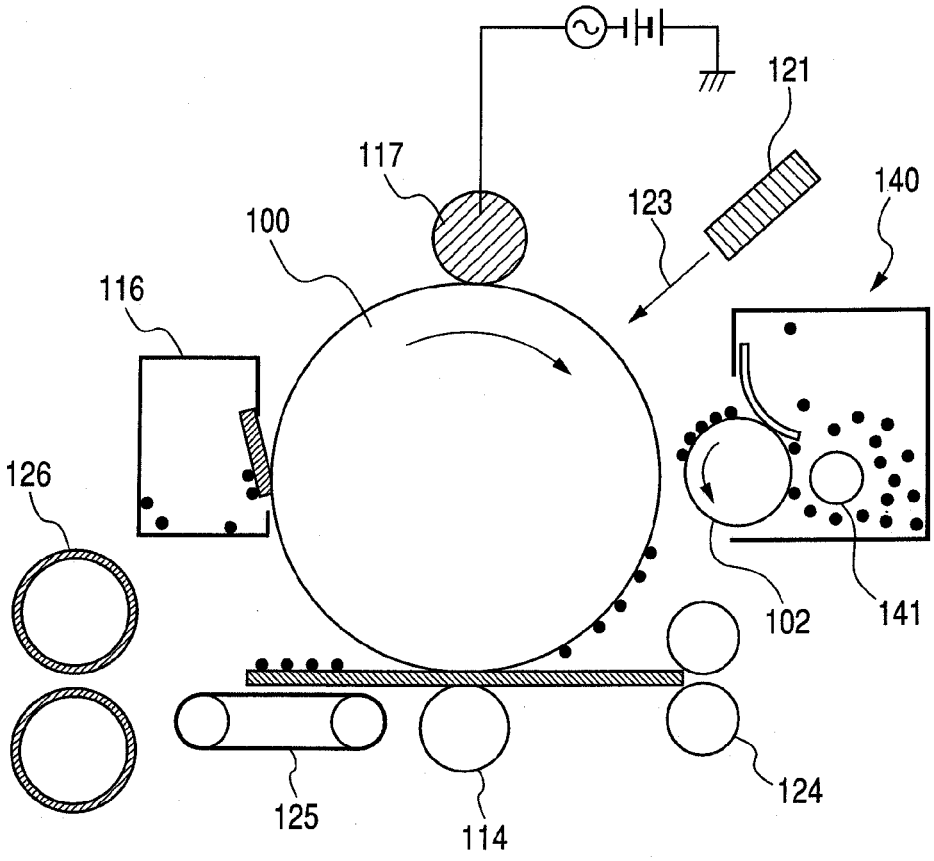

TONER

CROSS-REFERENCE TO RELATED APPLICATIONS

This application is a continuation of International Application No. PCT/JP2009/059941 filed May 26, 2009, which claims the benefit of Japanese Patent Application No. 2008-139237, filed May 28, 2008.

BACKGROUND OF THE INVENTION

1. Field of the Invention

This invention relates to a toner used in recording processes utilizing electrophotography, electrostatic recording, magnetic recording or toner jet recording.

2. Description of the Related Art

A number of methods are conventionally known as methods for electrophotography. In general, copies or prints are obtained by forming an electrostatic latent image on an electrostatically charged image bearing member (hereinafter also termed "photosensitive member") by utilizing a photoconductive material and by various means, subsequently developing the latent image by the use of a toner to form a toner image as a visible image, further transferring the toner image to a recording medium such as paper as occasion calls, and then fixing the toner image onto the recording medium by the action of heat and/or pressure. Apparatus for such image formation include copying machines, printers and so forth.

These printers or copying machines are being changed over from analogue machines to digital machines, and it is strongly sought to have a good reproducibility of latent images and a high resolution and at the same time to be made high-speed and reduce power consumption in their use. Here, take note of printers, for example. The proportion of power consumption in the fixing step is fairly large in respect to the total power consumption, and hence the power consumption may increase with a rise in fixing temperature. A high fixing temperature may also cause problems such as curl of image-printed paper after fixing. Accordingly, there is a great desire for making fixing temperature lower.

Meanwhile, there is also a great desire for on-demand performance in printers and copying machines, and, in recent years, what is called a film fixing assembly and a magnetic induction type fixing assembly have been brought forth. These fixing assemblies have a very good on-demand performance. However, it is the case that, compared with conventional heat roller type fixing assemblies, pressure is applicable with difficulty to make the fixing performable with greater difficulty.

Further, printers need to deal with a variety of recording materials, and hence there is a great desire for a toner having a good fixing performance in a broad temperature region. Also, the printers or copying machines, which are sought to reduce power consumption, are on the other hand being made more high-speed, where the toner is also required to be improved in running stability.

To cope with the above, many studies have been made on how toners are made fixable at a low temperature, and it is reported that the use of a polyfunctional ester wax enables improvement in low-temperature fixing performance (see Japanese Patent Laid-open Applications No. 2000-019768 and No. 2006-098745 and International Publication WO98/20396).

A toner is also proposed which makes use of a polyfunctional ester wax having a specific solubility in styrene monomers and a specific molecular weight, and it is reported that the toner has superior low-temperature fixing performance and images with a high resolution are obtainable (see International Publication WO01/01200 and Japanese Patent Laid-open Application No. 2001-147550).

It is further reported that the use of two types of waxes in combination enables improvement in low-temperature fixing performance (see Japanese Patent Laid-open Applications No. H11-218960, No. 2002-072540 and No. 2002-072546).

However, even with use of such toners, it has not well been succeeded in achieving both the on-demand performance and the low-temperature fixing performance, and it has been insufficient to be adaptable to high-speed processing. Moreover, there has been room for much further improvement also in respect of image stability during long-term service.

SUMMARY OF THE INVENTION

The present invention has been made taking account of the above problems the background art has had. Accordingly, an object of the present invention is to provide a toner which has superior low-temperature fixing performance and can enjoy a high image density without causing any fog even during long-term service.

The present invention provides a toner having toner particles containing at least a binder resin, a colorant, an ester compound and a low-melting material; the ester compound being an ester of dipentaerythritol with a carboxylic acid having 18 or more to 25 or less carbon atoms; and where the melting point of the ester compound is represented by $Tm_{(A)}$ (° C.) and the melting point of the low-melting material is represented by $Tm_{(B)}$ (° C.), the toner satisfying the relationship of:

$$Tm_{(B)} \leq Tm_{(A)} + 5.$$

According to the present invention, it can have superior low-temperature fixing performance and can enjoy a high image density without causing any fog even during long-term service.

Further features of the present invention will become apparent from the following description of exemplary embodiments with reference to the attached drawing.

BRIEF DESCRIPTION OF THE DRAWING

The FIGURE is a diagrammatic sectional view showing an example of an image forming apparatus in which the toner of the present invention is favorably usable.

DESCRIPTION OF THE EMBODIMENTS

Preferred embodiments of the present invention will now be described in detail in accordance with the accompanying drawings.

As a result of studies made by the present inventors, it has turned out that the use of an ester compound of dipentaerythritol with a carboxylic acid having 18 or more to 25 or less carbon atoms in combination with a low-melting material and the controlling of the melting points of the both enables the toner to have superior on-demand fixing performance, have very good low-temperature fixing performance and enjoy a high image density without causing any fog even during long-term service. Thus, they have accomplished the present invention.

First, regarding the ester compound used in the present invention, components constituting the ester compound are dipentaerythritol and a long-chain carboxylic acid having 18 or more to 25 or less carbon atoms, which are very bulky.

Hence, the ester compound may soak into the binder resin with difficulty even though it has melted by heat applied at the time of fixing, so that, if such an ester compound is used alone, it can not bring out any sufficient plasticizing effect to make any good fixing performance achievable.

However, such an ester compound and a low-melting material that satisfies the relationship of $Tm_{(B)} \leqq Tm_{(A)}+5$ where the melting point of the ester compound is represented by $Tm_{(A)}$ (° C.) and the melting point of the low-melting material is represented by $Tm_{(B)}$ (° C.) are used in combination. In such a case, the toner can be very improved in its low-temperature fixing performance. As to the reason therefor, the present inventors consider it as explained below:

As stated above, the ester compound as used in the present invention may soak into the binder resin with difficulty even though it has melted by heat applied at the time of fixing. However, since it does not soak into the binder resin even though it has melted, toner particles are considered to stand closely in liquid-at-core structure (being so structured as to be liquid at cores) in their interiors. In such a case, although the ester compound does not soak out of the toner particles, the toner particles are considered to stand readily deformable by pressure acting from the outside at the time of fixing.

In addition, the ester compound in the present invention is, as being highly bulky, considered to come to more increase in volume than other compounds when it melts. Hence, any pressure acting from the interiors of toner particles increases to make them stand deformable with ease as toner particles, as so considered.

In the present invention, it is essential to use the low-melting material (what is called wax) that satisfies the relationship of $Tm_{(B)} \leqq Tm_{(A)}+5$. The use of such a low-melting material and the ester compound in combination enables achievement of a very good low-temperature fixing performance for the first time.

This is because the ester compound has a melting point closed to that of the low-melting material (or the low-melting material has a lower melting point than the former). Thus, it follows that the ester compound melts at the time the ester compound and the low-melting material have substantially simultaneously melted or the low-melting material has melted, so that a good releasability can be achieved which is good for the ester compound to push out the low-melting material. Further, since the ester compound may soak into the binder resin with difficulty, toner particles come to stand closely in liquid-at-core structure, so that the toner particles can be deformed by pressure acting from the outside at the time of fixing to promise good anchoring to recording mediums, as so considered. Here, in the toner of the present invention, it is preferable that the ester compound and the low-melting material are enclosed in the binder resin to have an islands-in-sea structure in which the binder resin forms the sea and the ester compound and the low-melting material form the islands.

Thus, the present inventors consider that the effect brought by both the good releasability and the good anchoring to recording mediums enables achievement of a very good low-temperature fixing performance.

The ester compound as in the present invention also has a higher crystallinity and higher sharp-melt properties than any other crystalline polymers, and hence is highly adaptable even to printers or copying machines having high process speeds and favorably usable also for on-demand fixing assemblies.

For such reasons, it is important that the toner of the present invention contains the low-melting material and the specific ester compound of dipentaerythritol and that, where the melting point of the ester compound is represented by $Tm_{(A)}$ (° C.) and the melting point of the low-melting material is represented by $Tm_{(B)}$ (° C.), the toner satisfies the relationship of $Tm_{(B)} \leqq Tm_{(A)}+5$.

If on the other hand the ester compound in the present invention is a monoester or an ester compound having few functional groups, of glycerol or erythrithol, or makes use of a carboxylic acid having 17 or less carbon atoms, such a compound tends to come to soak into the resin to make it difficult to obtain the above effect, resulting in an inferior fixing performance.

In addition, any use of a high-molecular material such as tripentaerythrithol or a dehydration condensation product of glycerol makes the ester compound tend to take various crystalline states and hence have poor sharp-melt properties, resulting in a lowering of fixing performance.

Further, any compound of dipentaerythritol with a carboxylic acid having 26 or more carbon atoms may have too high a melting point to achieve a good fixing performance with ease. Still further, such a compound may inevitably come poorly dispersible in toner particles to cause, e.g., fog seriously.

Then, if the low-melting material has a melting point higher by more than 5° C. than the melting point of the ester compound, the push-out effect attributable to the ester compound may be obtained with difficulty to make any good fixing performance not achievable. The low-melting material may much preferably have a melting point not higher than the melting point of the ester compound ($Tm_{(B)} \leqq Tm_{(A)}$).

The ester compound used in the present invention may also preferably have a solubility S(A) in a styrene-acrylic resin, of 2.5% or less, and much preferably 2.0% or less.

That the ester compound used in the present invention has a solubility S(A) in a styrene-acrylic resin, of 2.5% or less is preferable because the ester compound may soak into the resin with greater difficulty to make the toner more improved in fixing performance.

The solubility S(A) in a styrene-acrylic resin, of the ester compound used in the present invention may be controlled by controlling the number of carbon atoms of the carboxylic acid to be used and the number of ester linkages.

The ester compound used in the present invention may have a solubility in a styrene monomer at 40° C., of less than 5.0% by mass. This is much preferable because the above effect is remarkably obtained. Where the toner is produced by suspension polymerization, which is favorable in producing the present toner, the ester compound may readily come deposited during the polymerization where it has the solubility in that monomer, of less than 5.0% by mass, and this makes cores readily formable in toner particles, as so considered. In the present invention, the ester compound has the function as stated above, and can be more effective when firm cores stand formed in the toner particles, and good fixing performance can be achieved, as so considered. Thus, it is preferable for the ester compound to have the solubility in a styrene monomer at 40° C., of less than 5.0% by mass.

As the low-melting material used in the present invention, any known wax may be used as long as it is one satisfying the requirements prescribed herein. In particular, it is preferable that the low-melting material has a solubility S(B) in a styrene-acrylic resin, of from 5.5% or more to 20.0% or less and that S(A)<S(B).

As to the reason therefor, the low-melting material as described above can bring out good fixing performance by being pushed out by the ester compound. However, where the low-melting material has the solubility S(B) in a styrene-acrylic resin, of 5.5% or more, it immediately plasticizes the binder resin of the toner when pushed out, to effect better fixing. That the low-melting material has the solubility S(B) in a styrene-acrylic resin, of 20.0% or less is also preferable because the toner is improved in storage stability.

That S(A)<S(B) is also preferable because the push-out effect the ester compound has is more remarkably brought out and hence the releasability is improved at the time of fixing.

The ester compound used in the present invention may preferably be added in an amount of from 3.0 parts by mass or more to 20.0 parts by mass or less, based on 100 parts by mass of the binder resin of the toner.

The ester compound may be added in the amount within the above range, where the ester compound can keep a good dispersibility to bring a more improvement in developing performance. Further, this is very preferable because the effect of pushing out the low-melting material and the effect of promoting deformation of toner particles in virtue of the liquid-at-core structure can be sufficient.

The low-melting material used in the present invention may be in a content from 1.2 times or more to 3.0 times or less the content of the ester compound by mass. This is preferable because the toner can achieve a good fixing performance and also can be improved in developing performance and any fog can be kept from occurring.

The ester compound used in the present invention may preferably have a melting point of from 70° C. or more to 90° C. or less. Where the ester compound has its melting point within the above rage, the toner can have a superior low-temperature fixing performance and also can maintain a good image density even in long-term service.

In order to develop minuter latent image dots for achieving much higher image quality, the toner of the present invention may preferably have a weight-average particle diameter (D4) of from 3 μm or more to 12 μm or less, and much preferably from 4 μm or more to 9 μm or less.

The toner of the present invention may preferably have an average circularity of 0.950 or more. Inasmuch as the toner has an average circularity of from 0.950 or more, the toner has a spherical or closely spherical particle shape and has a good fluidity, and can readily have uniform triboelectric chargeability. This can make ghost and electrostatic offset much less occur. The toner may also have a modal circularity of 0.98 or more in its circularity distribution. This is much preferable because the above operation is more remarkable.

The toner of the present invention may preferably have a peak top of the main peak in the region of molecular weight of from 10,000 or more to 40,000 or less, and much preferably have the peak top of the main peak in the region of from 12,000 to 30,000, in its molecular weight distribution measured by gel permeation chromatography (GPC) of THF-soluble matter of the toner. That the toner has the peak top in the region of molecular weight of from 10,000 or more to 40,000 or less is preferable because the toner is improved in low-temperature fixing performance and also improved in storage stability.

In the toner of the present invention, it is preferable that its binder resin component has tetrahydrofuran(THF)-insoluble matter, and that the THF-insoluble matter is in a content of from 5.0% by mass or more to 65.0% by mass or less, based on the binder resin component. The presence of such THF-insoluble matter in the toner enhances the strength of toner and makes the toner not easily deteriorate during long-term service, so that highly colorful images can be obtained even during long-term service.

The toner melts by heat received from a fixing assembly at the time of fixing, where, inasmuch as it has the THF-insoluble matter in a content of from 5.0% by mass or more to 65.0% by mass or less, it can have an appropriate elasticity even at the time of melting. Hence, this is preferable because the toner can not easily cause any high-temperature offset and can enjoy a broad fixing range.

The THF-insoluble matter of the binder resin component of the toner may be measured in the following way. The toner is precisely weighed in an amount of 1 g, which is then put in a cylindrical filter paper and is subjected to Soxhlet extraction for 20 hours using 200 ml of THF. Thereafter, the cylindrical filter paper is taken out, and then vacuum-dried at 40° C. for 20 hours to measure the weight of residues. The THF-insoluble matter is calculated according to the following expression. Here, the binder resin component of the toner is the component obtained by removing from the toner a charge control agent, release agent components (the low-melting material and the low-melting material), external additives, a pigment and a magnetic powder. In the measurement of the THF-insoluble matter, whether or not these contents are soluble or insoluble in THF is taken into account, and the THF-insoluble matter on the basis of the binder resin component is calculated.

$$\text{THF-insoluble matter (\% by mass)}=\{(W2-W3)/(W1-W3-W4)\}\times 100$$

wherein W1 is the mass of toner; W2 is the mass of residues; W3 is the mass of components insoluble in THF, other than the binder resin component; and W4 is the mass of components soluble in THF, other than the binder resin component.

The THF-insoluble matter of the binder resin component of the toner may be controlled by combination of the types and amounts of a polymerization initiator and a cross-linking agent which are to be used. It may also be controlled by using a chain transfer agent and the like.

The ester compound used in the present invention is a hexafunctional ester having as an alcohol component the dipentaerythritol and as an acid component the carboxylic acid having 18 or more to 25 or less carbon atoms.

The carboxylic acid having 18 or more to 25 or less carbon atoms may specifically include stearic acid, oleic acid, vaccenic acid, linolic acid, eleostearic acid, tuberculostearic acid, arachidic acid, arachidonic acid, behenic acid, lignoceric acid and nervonic acid. In particular, saturated fatty acids are preferred.

The ester compound used in the present invention may preferably have a hydroxyl value of 10 mgKOH/g or less and may preferably have an acid value of 10 mgKOH/g or less. Having a hydroxyl value of 10 mgKOH/g or less and an acid value of 10 mgKOH/g or less means that any unreacted acid component or unreacted alcohol component or any ester compound that is not the hexafunctional ester is little present. In this case, the ester compound can not easily come to migrate toward toner particles surfaces during long-term storage of the toner, and hence the toner can not easily become low in charge quantity, and any density decrease or serious fog can be kept from occurring.

The wax usable as the low-melting material used in the present invention may include, e.g., petroleum waxes and derivatives thereof such as paraffin wax, microcrystalline wax and petrolatum; montan wax and derivatives thereof; hydrocarbon waxes obtained by Fischer-Tropsch synthesis, and derivatives thereof; polyolefin waxes typified by polyethylene wax, and derivatives thereof; and naturally occurring waxes such as carnauba wax and candelilla wax, and derivatives thereof. Here, the derivatives include oxides, block copolymers with vinyl monomers, and graft modified products. Also usable are higher aliphatic alcohols, fatty acids such as stearic acid and palmitic acid, or compounds thereof, acid amide waxes, ester waxes, ketones, hardened caster oil and derivatives thereof, vegetable waxes, and animal waxes. Where a styrene copolymer is used as the binder resin, paraffin wax and Fischer-Tropsch wax are preferred, which may readily soak into the resin at the time of melting. These waxes are those composed of hydrocarbons having low molecular weight and having few branched chains. In virtue of such structure, they have a high affinity for the binder resin, as so presumed.

The binder resin used in the present invention may include homopolymers of styrene or derivatives thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins and polyacrylic acid resins. Any of these may be used alone or in combination of two or more types. Of these resins, taking account of the property that the ester compound used in the present invention soaks into the resin together with the low-melting material at the time of melting, styrene copolymers are particularly preferred.

The toner of the present invention may optionally be mixed with a charge control agent in order to improve charging performance. As the charge control agent, any known charge control agent may be used. In particular, charge control agents which can give speedy charging and also can maintain a constant charge quantity stably are preferred. Further, where the toner particles are produced by polymerization as described later, it is particularly preferable to use charge control agents having a low polymerization inhibitory action and being substantially free of any solubilizate to the aqueous dispersion medium. Among such charge control agents, as specific compounds, they may include, as negative charge control agents, metal compounds of aromatic carboxylic acids such as salicylic acid, alkylsalicylic acids, dialkylsalicylic acids, naphthoic acid and dicarboxylic acids; metal salts or metal complexes of azo dyes or azo pigments; polymeric compounds having a sulfonic acid or carboxylic acid group in the side chain; and boron compounds, urea compounds, silicon compounds, and carixarene. As positive charge control agents, they may include quaternary ammonium salts, polymers having such a quaternary ammonium salt in the side chain, guanidine compounds, Nigrosine compounds and imidazole compounds.

As methods for making toner particles contain the charge control agent, commonly available are a method of internally adding it to the toner particles, and, in the case when the toner is produced by suspension polymerization, a method in which the charge control agent is added to a polymerizable monomer composition before its granulation. A polymerizable monomer in which the charge control agent has been dissolved or suspended may be added in the midst of forming oil droplets in water to effect polymerization, or after the polymerization, to carry out seed polymerization so as to cover toner particle surfaces uniformly. Further, where an organometallic compound is used as the charge control agent, such a compound may be added to the toner particles and these may be mixed and agitated under application of a shear to incorporate it into toner particles.

The quantity of this charge control agent used depends on the type of the binder resin, the presence of any other additives, and the manner by which the toner is produced, inclusive of the manner of dispersion, and can not absolutely be specified. When added internally, however, the charge control agent may preferably be used in an amount ranging from 0.1 part by mass or more to 10.0 parts by mass or less, and much preferably from 0.1 part by mass or more to 5.0 parts by mass or less, based on 100 parts by mass of the binder resin. When added externally, it may preferably be added in an amount of from 0.005 part by mass or more to 1.000 part by mass or less, and much preferably from 0.01 part by mass or more to 0.30 part by mass or less, based on 100 parts by mass of the toner particles.

The toner of the present invention contains a colorant adapted to the intended tint. The colorant used in the toner of the present invention may include known organic pigments or dyes, carbon black and magnetic powders, any of which may be used.

Stated specifically, as cyan colorants, usable are copper phthalocyanine compounds and derivatives thereof, anthraquinone compounds, basic dye lake compounds and so forth. Stated specifically, they may include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

As magenta colorants, usable are condensation azo compounds, diketopyrrolopyrrole compounds, anthraquinone compounds, quinacridone compounds, basic-dye lake compounds, naphthol compounds, benzimidazolone compounds, thioindigo compounds and perylene compounds. Stated specifically, they may include C.I. Pigment Red 2, C.I. Pigment Red 3, C.I. Pigment Red 5, C.I. Pigment Red 6, C.I. Pigment Red 7, C.I. Pigment Red 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

As yellow colorants, usable are compounds typified by condensation azo compounds, isoindolinone compounds, anthraquinone compounds, azo metal complexes, methine compounds and allylamide compounds. Stated specifically, they may include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

Any of these colorants may be used alone, in the form of a mixture, or further in the state of a solid solution. The colorant used in the toner of the present invention is selected taking account of hue angle, chroma, brightness, light-fastness, transparency on OHP films and dispersibility in toner particles. The colorant may preferably be added in an amount of from 1 part by mass or more to 20 parts by mass or less, based on 100 parts by mass of the binder resin.

As black colorants, carbon black, a magnetic powder and a colorant toned in black by the use of yellow, magenta and cyan colorants shown above may be used. In the case when the carbon black is used as a black colorant, it may preferably be used in its addition in an amount of from 1 part by mass or more to 20 parts by mass or less, based on 100 parts by mass of the binder resin. Also, where the toner of the present invention is used as a magnetic toner, the magnetic powder may preferably be added in an amount of from 20 parts by mass or more to 150 parts by mass or less, based on 100 parts by mass of the binder resin.

In the case when the magnetic powder is used as the colorant, other colorant may also be used in combination. Such a colorant usable in combination may include magnetic or non-magnetic inorganic compounds besides the above known dyes and pigments. Stated specifically, it may include ferromagnetic metal particles of cobalt, nickel or the like, or particles of alloys of any of these metals to which chromium, manganese, copper, zinc, aluminum, a rare earth element or the like has been added; as well as particles of hematite or the like, titanium black, nigrosine dyes or pigments, carbon black, and phthalocyanine. These may also be used after their particle surface hydrophobic treatment.

The content of the magnetic powder in the toner may be measured with a thermal analyzer TGA7, manufactured by Perkin-Elmer Corporation. A measuring method is as follows: The toner is heated at a heating rate of 25° C./minute from normal temperature to 900° C. in an atmosphere of nitrogen. The mass (%) of weight loss in the course of from 100° C. to 750° C. is regarded as the binder resin weight, and the residual mass is approximately regarded as the magnetic-powder weight.

In the case when in the present invention the toner is produced by polymerization, attention must be paid to polymerization inhibitory action or aqueous-phase transfer properties inherent in the colorant. Accordingly, it is better for the colorant to be beforehand subjected to surface modification, e.g., hydrophobic treatment with a material free from polymerization inhibition. In particular, most dyes and carbon black have the polymerization inhibitory action and hence care must be taken when used. With regard to the carbon black, it may be treated with a material capable of reacting with surface functional groups of the carbon black, as exemplified by a polyorganosiloxane.

In the case when the magnetic powder is used in the toner of the present invention, the magnetic powder is what is chiefly composed of a magnetic iron oxide such as triiron tetraoxide or γ-iron oxide, and may also contain any of elements such as phosphorus, cobalt, nickel, copper, magnesium, manganese, aluminum and silicon. Any of these magnetic powders may preferably have a BET specific surface area, as measured by the nitrogen gas adsorption method, of from 2 $m^2/g$ or more to 30 $m^2/g$ or less, and much preferably from 3 $m^2/g$ or more to 28 $m^2/g$ or less. As the particle shape of the magnetic powder, it may be, e.g., polygonal, octahedral, hexahedral, spherical, acicular or flaky. Polygonal, octahedral, hexahedral or spherical ones are preferred as having less anisotropy, which are preferable in order to improve image density.

The magnetic powder may preferably have a volume average particle diameter (Dv) of from 0.10 μm or more to 0.40 μm or less. That the magnetic powder has a volume average particle diameter (Dv) of from 0.10 μm or more to 0.40 μm or less is preferable because the magnetic powder can have a good dispersibility and the toner is improved in coloring power.

The volume-average particle diameter of the magnetic powder may be measured with a transmission electron microscope. Stated specifically, toner particles to be observed are well dispersed in epoxy resin, followed by curing for 2 days in an environment of temperature 40° C. to obtain a cured product. The cured product obtained is cut out in slices by means of a microtome to prepare a sample, where the particle diameter of 100 magnetic-powder particles in the visual field is measure on a photograph taken at 10,000 magnifications to 40,000 magnifications using a transmission electron microscope (TEM). Then, the volume-average particle diameter (Dv) is calculated on the basis of circle-equivalent diameter equal to the particle projected area of the magnetic powder. The particle diameter may also be measured with an image analyzer.

The magnetic powder usable in the present invention may be produced in the following way, for example. To an aqueous ferrous salt solution, an alkali such as sodium hydroxide is added in an equivalent weight, or more than equivalent weight, with respect to the iron component to prepare an aqueous solution containing ferrous hydroxide. Into the aqueous solution thus prepared, air is blown while its pH is maintained at pH 7 or above, and the ferrous hydroxide is made to undergo oxidation reaction while the aqueous solution is heated at 70° C. or more to firstly form seed crystals serving as cores of magnetic ion oxide particles.

Next, to a slurry-like liquid containing the seed crystals, an aqueous solution containing ferrous sulfate in about one equivalent weight on the basis of the quantity of the alkali previously added is added. The reaction of the ferrous hydroxide is continued while the pH of the liquid is maintained at 5 or more to 10 or less and air is blown, to cause magnetic iron oxide particles to grow about the seed crystals as cores. At this stage, any desired pH, reaction temperature and stirring conditions may be selected so that the particle shape and magnetic properties of the magnetic powder can be controlled. With progress of oxidation reaction, the pH of the liquid comes to shift to acid side, but the pH of the liquid may preferably be so adjusted as not to be made less than 5. The magnetic material thus obtained may be filtered, followed by washing and then drying all by conventional methods to obtain the magnetic powder.

In the case when in the present invention the toner is produced by polymerization, it is very preferable for the particle surfaces of the magnetic powder to be subjected to hydrophobic treatment. Where such hydrophobic treatment is carried out by a dry process, a coupling agent is added to the magnetic powder obtained as a result of washing, filtration and drying, to carry out hydrophobic treatment. Where the hydrophobic treatment is carried out by a wet process, those having been dried after the oxidation reaction has been completed are again dispersed. As another method, the iron oxide material obtained by the oxidation reaction having been completed, followed by washing and filtration, may be again dispersed in a different aqueous medium without being dried, where a coupling agent may be added to carry out hydrophobic treatment. Stated specifically, a silane coupling agent is added to the one dispersed again, with its thorough stirring, and the temperature may be raised after hydrolysis or the pH may be adjusted to the alkaline side to carry out hydrophobic treatment. Of these, from the viewpoint of carrying out uniform hydrophobic treatment, it is preferable that what has been obtained by the oxidation reaction having been completed, followed by filtration and washing, is formed into a slurry as it is, without being dried, and then the hydrophobic treatment is carried out.

To carry out the hydrophobic treatment of the magnetic powder by the wet process, i.e., the magnetic powder is hydrophobic-treated in an aqueous medium, the magnetic powder is first sufficiently dispersed in the aqueous medium so as to become primary particles, and then stirred with a stirring blade or the like so as not to settle or agglomerate. Next, the coupling agent is introduced in the resultant dispersion in any desired amount, and the hydrophobic treatment is carried out while hydrolyzing the coupling agent. In this case as well, it is much preferable to carry out the hydrophobic treatment while carrying out dispersion sufficiently so as not to cause agglomeration, with stirring and using an apparatus such as a pin mill or a line mill.

Here, the aqueous medium is a medium composed chiefly of water. Stated specifically, it may include water itself, water to which a surface-active agent has been added in a small quantity, water to which a pH adjuster has been added, and water to which an organic solvent has been added. As the surface-active agent, a nonionic surface-active agent such as polyvinyl alcohol is preferred. The pH adjuster may include inorganic acids such as hydrochloric acid. The organic solvent may include alcohols.

The coupling agent usable in the hydrophobic treatment of the magnetic powder in the present invention may include, e.g., silane coupling agents and titanium coupling agents. Preferably usable is a silane coupling agent, which is one represented by the general formula (A):

$$R_mSiY_n \quad (A)$$

wherein R represents an alkoxyl group; m represents an integer of 1 or more to 3 or less; Y represents a functional group such as an alkyl group, a vinyl group, an epoxy group, an acrylic group or a methacrylic group; and n represents an integer of 1 or more to 3 or less, provided that m+n=4.

The silane coupling agent represented by the general formula (A) may include, e.g., vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane and n-octadecyltrimethoxysilane.

Of these, from the viewpoint of providing the magnetic powder with a high hydrophobicity, an alkyltrialkoxysilane compound represented by the following formula (B) may preferably be used.

$$C_pH_{2q+1}—Si—(OC_pH2_{q+1})_3 \quad (B)$$

wherein p represents an integer of 2 or more to 20 or less, and q represents an integer of 1 or more to 3 or less.

In the above formula, if p is smaller than 2, it is difficult to provide the magnetic powder with a sufficient hydrophobicity. If p is larger than 20, though hydrophobicity can be sufficient, the magnetic powder particles may greatly coalesce one another, undesirably. Further, if q is larger than 3, the silane compound may have a low reactivity to make it hard for the magnetic powder to be made sufficiently hydrophobic. Accordingly, it is preferable to use an alkyltrialkoxysilane compound in which the p in the formula represents an integer of 2 or more to 20 or less (much preferably an integer of 3 or more to 15 or less) and the q represents an integer of 1 or more to 3 or less (much preferably an integer of 1 or 2).

In the case when the above silane compound is used, the treatment may be carried out using it alone, or using a plurality of types in combination. In using a plurality of types in combination, the treatment may be carried out using the respective coupling agents separately, or the treatment may be carried out using them simultaneously.

The silane compound used may preferably be in a total treatment quantity of from 0.9 part by mass or more to 3.0 parts by mass or less, based on 100 parts by mass of the magnetic powder, and it is important to control the amount of the treating agent in accordance with the surface area of the magnetic powder, the reactivity of the silane compound, and so forth.

The toner of the present invention may preferably have a glass transition temperature (Tg) of from 40° C. or more to 70° C. or less. That it has a glass transition temperature of from 40° C. or more to 70° C. or less is preferable because the toner can achieve both fixing performance and storage stability.

The toner of the present invention may preferably have a core-shell structure in order to improve its storage stability and more improve its developing performance. This is because having shell layers makes the toner particles uniform in surface properties, improved in fluidity and also uniform in chargeability.

In addition, since the shell uniformly covers the surface layer, the bleeding of the low-melting material hardly occurs even during long-term storage of toner, so that the toner is improved in the storage stability.

To that end, it is preferable for the shell layers to use an amorphous resin for shells, which may preferably have an acid value of 5.0 mgKOH/g or more to 20.0 mgKOH/g or less from the viewpoint of the stability of charging.

As a specific means for forming such shells, fine particles for shells may be buried in core particles. Also, where the toner is produced in an aqueous medium, which is a production method favorable for the present invention, ultrafine particles for shells may be made to adhere to core particles, followed by drying to form shell layers. Still also, when produced by solution polymerization or suspension polymerization, the acid value and hydrophilicity of a resin for shells may be utilized to make such a high-molecular weight material localized at the interface between it and water, i.e., at toner particles surfaces and in the vicinity thereof to form shell layers. Further, a monomer may be swelled on core particle surfaces and polymerized by what is called seed polymerization, to form shell layers.

The resin for shells may include, e.g., homopolymers of styrene or derivatives thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, a styrene-polyester copolymer, a polyacrylate-polyester copolymer, a polymethacrylate-polyester copolymer, polyamide resins, epoxy resins, polyacrylic acid resins, terpene resins and phenol resins. Any of these may be used alone or in combination of two or more types. A functional group such as an amino group, a carboxyl group, a hydroxyl group, a sulfonic acid group, a glycidyl group or a nitrile group may also be introduced into any of these polymers.

Any of these resins may preferably be added in an amount of from 1 part by mass or more to 30 parts by mass or less, based on 100 parts by mass of the polymerizable monomer.

Of these resins, polyester resin is preferred because it can greatly bring out the above effect. The polyester resin used in the present invention may be either or both of a saturated polyester resin and an unsaturated polyester resin, which may be used under appropriate selection.

The resin that forms shells may have a number average molecular weight of from 2,500 or more to 10,000 or less, which may preferably be used. This is preferable because one having a number average molecular weight of 2,500 or more brings improvements in anti-blocking properties and running performance and one having a number average molecular weight of 10,000 or less does not inhibit the low-temperature fixing performance. The number average molecular weight may be measured by GPC.

The toner of the present invention may be produced by any known process. First, where it is produced by a pulverization process, for example, components necessary as the toner, such as the binder resin, the colorant, the ester compound and the low-melting material, and other additives, are thoroughly mixed by means of a mixer such as Henschel mixer or a ball mill. Thereafter, the mixture obtained is melt-kneaded by means of a heat kneading machine such as a heat roll, a kneader or an extruder to make toner materials dispersed or dissolved, followed by cooling to solidify, then pulverization, thereafter classification, and optionally surface treatment to obtain toner particles. Either of the classification and the surface treatment may be first in order. In the step of classification, a multi-division classifier may preferably be used in view of production efficiency.

The pulverization step may be carried out by using a known pulverizer such as a mechanical impact type or a jet type. In order to obtain the toner having the specific circularity preferable in the present invention, it is preferable to further apply heat to effect pulverization or to carry out treatment of adding mechanical impact auxiliarily. Also usable are a hot-water bath method in which toner particles finely pulverized (and optionally classified) are dispersed in hot water, a method in which the toner particles are passed through hot-air streams, and so forth.

As means for applying mechanical impact force, available are, e.g., a method making use of a mechanical impact type pulverizer such as Kryptron system, manufactured by Kawasaki Heavy Industries, Ltd., or Turbo mill, manufactured by Turbo Kogyo Co., Ltd. A method may also be used in which toner particles are pressed against the inner wall of a casing by centrifugal force by means of a high-speed rotating blade to impart mechanical impact force to the toner particles by the force such as compression force or frictional force, as in apparatus such as a mechanofusion system manufactured by Hosokawa Micron Corporation or a hybridization system manufactured by Nara Machinery Co., Ltd.

The toner of the present invention may be produced by the pulverization process as described above. However, the toner particles obtained by such pulverization commonly have an amorphous shape, and hence any mechanical and thermal or any special treatment must be carried out in order to attain the physical properties that the average circularity is 0.950 or more, which is preferably used in the present invention. This may result in an inferior productivity. Accordingly, the toner of the present invention may preferably be obtained by producing toner particles in an aqueous medium, as in dispersion polymerization, association agglomeration, dissolution suspension or suspension polymerization. In particular, suspension polymerization may readily satisfy preferable physical properties required in the present invention, and is very preferred.

The suspension polymerization is a process in which the polymerizable monomer and the colorant (and further optionally a polymerization initiator, a cross-linking agent, a charge control agent and other additives) are uniformly dissolved or dispersed to make up a polymerizable monomer composition, and thereafter this polymerizable monomer composition is dispersed in a continuous phase (e.g., an aqueous phase) containing a dispersion stabilizer, by means of a suitable stirrer to carry out polymerization to obtain a toner having the desired particle diameters. In the toner obtained by this suspension polymerization (hereinafter also termed "polymerization toner"), the individual toner particles stand uniform in a substantially spherical shape, and hence the toner can readily obtained which satisfies the requirement on physical properties that the average circularity is 0.950 or more, which is preferable in the present invention. Moreover, such a toner can have a relatively uniform distribution of charge quantity, and hence can be expected to be improved in image quality.

In producing the polymerization toner according to the present invention, the polymerizable monomer making up the polymerizable monomer composition may include the following.

The polymerizable monomer may include styrene; styrene monomers such as o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamides. Any of these monomers may be used alone or in the form of a mixture. Of the foregoing monomers, styrene or a styrene derivative may preferably be used alone or in the form of a mixture with other monomer. This is preferable in view of developing performance and running performance of the toner.

As the polymerization initiator used in producing the toner of the present invention by polymerization, preferred is one having a half-life of from 0.5 hour or more to 30.0 hours or less. It may also be used in its addition in an amount of from 0.5 part by mass or more to 20 parts by mass or less, based on 100 parts by mass of the polymerizable monomer, to carry out polymerization. This enables the toner to be endowed with a desirable strength and appropriate melt properties.

As a specific polymerization initiator, it may include azo type or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate and t-butyl peroxypivarate.

In producing the toner of the present invention by polymerization, a cross-linking agent may be added, which may preferably be added in an amount of from 0.001 part by mass or more to 15.000 parts by mass or less, based on 100 parts by mass of the polymerizable monomer.

Here, as the cross-linking agent, compounds chiefly having at least two polymerizable double bonds may be used. It may include, e.g., aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups; any of which may be used alone or in the form of a mixture of two or more types.

In the method of producing the toner of the present invention by polymerization, commonly a polymerizable monomer composition prepared by adding the above toner-composing materials appropriately and dissolving or dispersing them by means of a dispersion machine such as a homogenizer, a ball mill or an ultrasonic dispersion machine is suspended in an aqueous medium containing a dispersion stabilizer. Here, a high-speed dispersion machine such as a high-speed stirrer or an ultrasonic dispersion machine may be used to make the toner particles have the desired particle size at a stretch. This can more readily make the resultant toner particles have a sharp particle size distribution. As the time at which the polymerization initiator is added, it may be added simultaneously when other additives are added to the polymerizable monomer, or may be mixed immediately before they are suspended in the aqueous medium. Also, immediately after granulation, the polymerization initiator may be added before the polymerization reaction is initiated.

After granulation, agitation may be carried out using a usual agitator in such an extent that the state of particles is maintained and also the particles can be prevented from floating and settling.

When the toner of the present invention is produced by polymerization, any of known surface-active agents or organic or inorganic dispersants may be used as a dispersion stabilizer. In particular, the inorganic dispersants may preferably be used because they may hardly cause any harmful ultrafine powder and they attain dispersion stability on account of their steric hindrance. As examples of such inorganic dispersants, they may include phosphoric acid polyvalent metal salts such as tricalcium phosphate, magnesium phosphate, aluminum phosphate, zinc phosphate and hydroxyl apatite; carbonates such as calcium carbonate and magnesium carbonate; inorganic salts such as calcium metasilicate, calcium sulfate and barium sulfate; and inorganic compounds such as calcium hydroxide, magnesium hydroxide and aluminum hydroxide.

Any of these inorganic dispersants may preferably be used in an amount of from 0.2 part by mass or more to 20.0 parts by mass or less, based on 100 parts by mass of the polymerizable monomer. The dispersion stabilizer may also be used alone or in combination of two or more types. It may further be used in combination with a surface-active agent.

Such a surface-active agent may include, e.g., sodium dodecylbenzene sulfate, sodium tetradecyl sulfate, sodium pentadecyl sulfate, sodium octyl sulfate, sodium oleate, sodium laurate, sodium stearate and potassium stearate.

In the step of polymerizing the polymerizable monomer, the polymerization may be carried out at a polymerization temperature set at 40° C. or more, and commonly at a temperature of from 50° C. or more to 90° C. or less. Inasmuch as the polymerization is carried out within this temperature range, the low-melting material to be enclosed in interiors is deposited by phase separation to come more perfectly enclosed in toner particles.

The polymerization toner particles may be, after the polymerization has been completed, subjected to filtration, washing and drying by conventional methods to obtain the toner particles. The toner particles thus obtained may optionally be mixed with an inorganic fine powder describe later. A classification step may also be added (before mixing with the inorganic fine powder) so as to remove coarse powder and fine powder present mixedly with the toner particles.

In the present invention, an inorganic fine powder having a number-average primary particle diameter (D1) of from 4 nm or more to 80 nm or less, and preferably from 6 nm or more to 40 nm or less, may externally be added to the toner particles as a fluidizing agent. This is also a preferred embodiment. The inorganic fine powder is added in order to improve the fluidity of the toner and make the charging of the toner particles uniform, where the inorganic fine powder may be subjected to treatment such as hydrophobic treatment so that the toner may further be endowed with the function to regulate its charge quantity and improve its environmental stability. This is also a preferred embodiment.

In the present invention, the number-average primary particle diameter (D1) of the inorganic fine powder may be measured with a scanning electron microscope, using a photograph of toner particles which is taken under magnification.

As the inorganic fine powder used in the present invention, fine silica powder, fine titanium oxide powder, fine alumina powder or the like may be used. As the fine silica powder, usable are, e.g., what is called dry-process silica or fumed silica produced by vapor phase oxidation of silicon halides and what is called wet-process silica produced from water glass or the like, either of which may be used. The dry-process silica is preferred, as having less silanol groups on the particle surfaces and particle interiors of the fine silica powder and leaving less production residues such as $Na_2O$ and $SO_3^{2-}$.

The above inorganic fine powder may preferably be added in an amount of from 0.1 part by mass or more to 3.0 parts by mass or less, based on 100 parts by mass of the toner particles. The content of the inorganic fine powder may quantitatively be determined by fluorescent X-ray analysis and using a calibration curve prepared from a standard sample.

In the present invention, the inorganic fine powder may be a powder having been hydrophobic-treated. This is preferable because the toner can be improved in environmental stability. Where the inorganic fine powder added to the toner has moistened, the toner particles may have a very low charge quantity and tend to have a non-uniform charge quantity, tending to cause toner scatter. As a treating agent used for such hydrophobic treatment of the inorganic fine powder, usable are treating agents such as a silicone varnish, a modified silicone varnish of various types, a silicone oil, a modified silicone oil of various types, a silane compound, a silane coupling agent, other organosilicon compound and an organotitanium compound, any of which may be used alone or in combination of two or more types.

Of such treating agents, those having been treated with silicone oil are preferred. Those obtained by subjecting the inorganic fine powder to hydrophobic treatment with a silane compound and, simultaneously with or after the treatment, treatment with silicone oil are much preferred. As a method for such treatment of the inorganic fine powder, for example, the inorganic fine powder may be treated, as first-stage reaction, with the silane compound to effect silylation reaction to cause silanol groups to disappear by chemical coupling, and thereafter, as second-stage reaction, with the silicone oil to form hydrophobic thin films on particle surfaces.

In order to, e.g., improve cleaning performance, inorganic or organic closely spherical fine particles having a number average particle diameter (D1) of 30 nm or more, and much preferably of 50 nm or more, may be added to the toner of the present invention. This is also one of preferred embodiments. For example, spherical silica particles, spherical polymethyl silsesquioxane particles or spherical resin particles may preferably be used.

How to measure various physical properties concerning the toner of the present invention is described below.

(1) Melting Points of Ester Compound and Low-Melting Material

The melting points of the ester compound and low-melting material are each found as a peak top of endothermic peaks when measured by DSC. The peak top of endothermic peaks is measured according to ASTM D34117-99. For the measurement, DSC-7, manufactured by Perkin-Elmer Corporation, DSC2920, manufactured by TA Instruments Japan Ltd., or Q1000, manufactured by TA Instruments Japan Ltd., may be used, for example. The temperature at the detecting portion of the measuring instrument is corrected on the basis of melting points of indium and zinc, and the amount of heat is corrected on the basis of heat of fusion of indium. The sample for measurement is put in a pan made of aluminum and an empty pan is set as a control.

(2) Weight Average Particle Diameter (D4) of Toner

The weight average particle diameter (D4) the toner is measured in the following way. A precision particle size distribution measuring instrument "Coulter Counter Multisizer 3" (registered trademark; manufactured by Beckman Coulter, Inc.) is used as a measuring instrument, which has an aperture tube of 100 μm in size and employing the aperture impedance method. To set the conditions for measurement and analyze the data of measurement, a software "Beckman Coulter Multisizer 3 Version 3.51" (produced by Beckman Coulter, Inc.) is used, which is attached to Multisizer 3 for its exclusive use. The measurement is made through 25,000 channels as effective measuring channels in number.

As an aqueous electrolytic solution used for the measurement, a solution may be used which is prepared by dissolving guaranteed sodium chloride in ion-exchanged water in a concentration of about 1% by mass, e.g., "ISOTON II" (available from Beckman Coulter, Inc.).

Here, before the measurement and analysis are made, the software for exclusive use is set in the following way.

On a "Change of Standard Measuring Method (SOM)" screen of the software for exclusive use, the total number of counts of a control mode is set to 50,000 particles. The number of time of measurement is set to one time and, as Kd value, the value is set which has been obtained using "Standard Particles, 10.0 μm" (available from Beckman Coulter, Inc.). Threshold value and noise level are automatically set by pressing "Threshold Value/Noise Level Measuring Button". Then, current is set to 1,600 μA, gain to 2, and electrolytic solution to ISOTON II, where "Flash for Aperture Tube after Measurement" is checked.

On a "Setting of Conversion from Pulse to Particle Diameter" screen of the software for exclusive use, the bin distance is set to logarithmic particle diameter, the particle diameter bin to 256 particle diameter bins, and the particle diameter range to from 2 μm to 60 μm.

A specific way of measurement is as follows:

(i) About 200 ml of the aqueous electrolytic solution is put into a 250 ml round-bottomed beaker made of glass for exclusive use in Multisizer 3, and this is set on a sample stand, where stirring with a stirrer rod is carried out at 24 revolutions/second in the anticlockwise direction. Then, "Flash of Aperture" function of the analysis software is operated to beforehand remove any dirt and air bubbles in the aperture tube.

(ii) About 30 ml of the aqueous electrolytic solution is put into a 100 ml flat-bottomed beaker made of glass. To this water, about 0.3 ml of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to about 3-fold by mass.

(iii) An ultrasonic dispersion machine of 120 W in electric output "Ultrasonic Dispersion system TETORA 150" (manufactured by Nikkaki Bios Co.) is readied, having two oscillators of 50 kHz in oscillation frequency which are built therein in the state their phases are shifted by 180 degrees. Into a water tank of the ultrasonic dispersion machine, about 3.3 liters of ion-exchanged water is put, and about 2 ml of CONTAMINON N is added to this water tank.

(iv) The beaker of the above (ii) is set to a beaker fixing hole of the ultrasonic dispersion machine, and the ultrasonic dispersion machine is set working. Then, the height position of the beaker is so adjusted that the state of resonance of the aqueous electrolytic solution surface in the beaker may become highest.

(v) In the state the aqueous electrolytic solution in the beaker of the above (iv) is irradiated with ultrasonic waves, about 10 mg of the toner is little by little added to the aqueous electrolytic solution and is dispersed therein. Then, such ultrasonic dispersion treatment is further continued for 60 seconds. In carrying out the ultrasonic dispersion treatment, the water temperature of the water tank is appropriately so controlled as to be 10° C. or more to 40° C. or less.

(vi) To the round-bottomed beaker of the above (i), placed inside the sample stand, the aqueous electrolytic solution in which the toner has been dispersed in the above (v) is dropwise added by using a pipette, and the measuring concentration is so adjusted as to be about 5%. Then the measurement is made until the measuring particles come to 50,000 particles in number.

(vii) The data of measurement are analyzed by using the above software attached to the measuring instrument for its exclusive use, to calculate the weight average particle diameter (D4). Here, "Average Diameter" on an "Analysis/Volume Statistic Value (Arithmetic Mean)" screen when set to graph/% by volume in the software for exclusive use is the weight average particle diameter (D4).

Measurement of Average Circularity of Toner

The average circularity of the toner is measured with a flow type particle analyzer "FPIA-2100" (manufactured by Sysmex Corporation). Details are as follows.

First, circularity is calculated according to the following expression.

Circularity=(circumferential length of a circle with the same area as particle projected area)/(circumferential length of particle projected image).

Herein, the "particle projected area" is the area of a binary-coded toner particle image, and the "circumferential length of particle projected image" is the length of a contour line formed by connecting edge points of the toner particle image. In the measurement, used is the circumferential length of a particle image in image processing at an image processing resolution of 512×512 (a pixel of 0.3 μm×0.3 μm).

The circularity referred to in the present invention is an index showing the degree of surface unevenness of toner particles. It is indicated as 1.00 when the toner particles are perfectly spherical. The more complicate the surface shape is, the smaller the value of circularity is.

Average circularity C which means an average value of circularity frequency distribution is calculated from the following expression where the circularity at a partition point i of particle size distribution is represented by ci, and the number of particles measured by m.

$$\text{Average circularity } C = \sum_{i=1}^{m} ci/m$$

A specific way of measurement is as follows: First, about 10 ml of ion-exchanged water, from which impurity solid matter and the like have beforehand been removed, is put into a container made of glass. To this water, about 0.1 ml of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to about 3-fold by mass. Further, about 0.02 g of a measuring sample is added, followed by dispersion treatment for 2 minutes by means of an ultrasonic dispersion machine to prepare a liquid dispersion for measurement. As the ultrasonic dispersion machine, an ultrasonic dispersion machine of 120 W in electric output "Ultrasonic Dispersion system TETORA 150 Model" (manufactured by Nikkaki Bios Co.) is used, having two oscillators of 50 kHz in oscillation frequency which are built therein in the state their phases are shifted by 180 degrees. Into an water tank of the ultrasonic dispersion machine, about 3.3 liters of ion-exchanged water is put, and about 2 ml of CONTAMINON N is added to this water tank. In that case, the liquid dispersion is appropriately cooled so that its temperature does not become 40° C. or more. Also, in order to keep the circularity from scattering, the environment in which the flow type particle analyzer FPIA-2100 is installed is controlled to 23° C.±0.5° C. so that the in-machine temperature of the analyzer can be kept at 26° C. to 27° C. Still also, autofocus control is performed using 2 μm standard latex particles (e.g., "RESEARCH AND TEST PARTICLES Latex Microsphere Suspensions 5200A, available from Duke Scientific Corporation) at intervals of constant time, and preferably at intervals of 2 hours.

In measuring the circularity of the toner particles, the above flow type particle analyzer is used and PARTICLE SHEATH PSE-900A (available from Sysmex Corporation) is used as a sheath solution. The liquid dispersion having been controlled according to the above procedure is introduced into the flow type particle analyzer, where the concentration of the liquid dispersion is again so controlled that the toner particle concentration at the time of measurement may be about 5,000 particles/μl. After the measurement, using the data obtained, the average circularity of toner particles with a circle-equivalent diameter of from 2.00 μm or more to less than 40.02 μm is determined. Here, the circle-equivalent diameter is the value calculated according to the following expression.

Circle-equivalent diameter=(particle projected area/$\pi$)$^{1/2}$×2.

(4) Measurement of Molecular Weight of THF-Soluble Matter of Toner

Molecular weight distribution of THF-soluble matter of the toner is measured by gel permeation chromatography (GPC) in the following way.

First, the toner is dissolved in tetrahydrofuran (THF) at room temperature over a period of 24 hours. Then, the solution obtained is filtered with a solvent-resistant membrane filter "MAISHORIDISK" (available from Tosoh Corporation) of 0.2 μm in pore diameter to make up a sample solution. Here, the sample solution is so controlled that the component soluble in THF is in a concentration of about 0.8% by mass. Using this sample solution, the measurement is made under the following conditions.

Instrument: HLC8120 GPC (detector: RI) (manufactured by Tosoh Corporation).

Columns: Combination of seven columns, Shodex KF-801, KF-802, KF-803, KF-804, KF-805, KF-806 and KF-807 (available from Showa Denko K.K.).

Eluent: Tetrahydrofuran (THF).

Flow rate: 1.0 ml/min.

Oven temperature: 40.0° C.

Amount of sample injected: 0.10 ml.

To calculate the molecular weight of the sample, a molecular weight calibration curve is used which is prepared using a standard polystyrene resin (e.g., trade name "TSK Standard Polystyrene F-850, F-450, F-288, F-128, F-80, F-40, F-20, F-10, F-4, F-2, F-1, A-5000, A-2500, A-1000, A-500"; available from Tosoh Corporation).

(5) Solubility of Ester Compound and Low-Melting Material in Styrene-Acrylic Resin The solubility of the ester compound and low-melting material in styrene-acrylic resin is measured in the following way.

First, the styrene-acrylic resin is synthesized in the following way.

In 720 parts by mass of ion-exchanged water, 450 parts by mass of an aqueous 0.1 mol/liter $Na_3PO_4$ solution is introduced, followed by heating to 60° C. Thereafter, to the resultant mixture, 67.7 parts by mass of an aqueous 1.0 mol/liter $CaCl_2$ solution is little by little added to obtain an aqueous medium containing a dispersion stabilizer.

| | |
|---|---|
| Styrene | 76.0 parts by mass |
| n-Butyl acrylate | 24.0 parts by mass |

Materials formulated as above are uniformly mixed using an attritor (manufactured by Mitsui Miike Engineering Corporation). The monomer mixture thus obtained is heated to 60° C., and thereafter 4.5 parts by mass of a polymerization initiator 2,2'-azobis(2,4-dimethylvaleronitrile) is dissolved therein.

The polymerizable monomer composition thus prepared is introduced into the above aqueous medium, followed by stirring for 10 minutes at 60° C. in an atmosphere of $N_2$, using a TK-type homomixer (manufactured by Tokushu Kika Kogyo Co., Ltd.) at 12,000 rpm to carry out granulation. Thereafter, the granulated product obtained is stirred with a paddle stirring blade during which the reaction was carried out at 70° C. for 5 hours. After the reaction has been completed, the resultant suspension is cooled, and hydrochloric acid is added thereto to effect washing, followed by filtration and then drying to obtain an unpurified styrene-acrylic resin.

The unpurified styrene-acrylic resin obtained is dissolved in tetrahydrofuran, and the solution thus obtained is dropwise added to methanol to effect purification by reprecipitation. After filtration, the product is dried to obtain the styrene-acrylic resin.

The styrene-acrylic resin thus obtained has a glass transition temperature (Tg) of from 54.0° C., a number-average molecular weight (Mn) of $2.0\times10^4$ and a weight-average molecular weight (Mw) of $2.0\times10^5$.

Styrene-acrylic resin obtained as above (resin obtained by polymerizing 74 parts by mass of styrene-acrylic resin and 26 parts by mass of n-butyl acrylate. Glass transition temperature (Tg): 54.0° C.; number-average molecular weight (Mn): 20,000; weight-average molecular weight (Mw): 200,000): 0.10 g Ester compound (or low-melting material): 0.01 g The above materials are mixed by means of an agate mortar to prepare a sample 1.

As a measuring instrument, "Q1000" (manufactured by TA Instruments Japan Ltd.) or "DSC2920" (manufactured by TA Instruments Japan Ltd.) may be used, which is a differential scanning calorimeter, and measurement is made according to ASTM D3418-82.

For example, using "Q1000", the sample 1 is precisely weighed in an amount of about 10 mg, which is then put in a pan made of aluminum and an empty pan is set as reference. Using these, the endothermic calorie is measure by the sequence shown below. The temperature at the detecting portion of the measuring instrument is corrected on the basis of melting points of indium and zinc, and the amount of heat is corrected on the basis of heat of fusion of indium.

Then, the endothermic peak calorie on the second cycle is taken as ΔH1, and the endothermic peak calorie on the fourth cycle as ΔH2, and solubility is found according to the following expression. Here, the endothermic peak calorie is defined to be the calorie at the maximum endothermic peak in a DSC curve in the range of temperatures of 30° C. to 120° C. in the course of heating.

$$\text{Solubility } S(\%)=(1-\Delta H2/\Delta H1)\times100.$$

—Sequence—

First Cycle:

Keeping at 30° C. for 1 minute.

Heating to 60° C. at a rate of 2° C./minute. After the heating, keeping for 10 minutes.

Cooling to 30° C. at a rate of 10° C./minute.

Second Cycle:

Keeping at 30° C. for 1 minute.

Heating to 120° C. at a rate of 10° C./minute. After the heating, keeping for 10 minutes.

Cooling to 30° C. at a rate of 10° C./minute.

Third Cycle:

Keeping at 30° C. for 1 minute.

Heating to 60° C. at a rate of 2° C./minute. After the heating, keeping for 10 minutes.

Cooling to 30° C. at a rate of 10° C./minute.

Fourth Cycle:

Keeping at 30° C. for 1 minute.

Heating to 120° C. at a rate of 10° C./minute. After the heating, keeping for 10 minutes.

Cooling to 30° C. at a rate of 10° C./minute.

Incidentally, it is preferable to use the styrene-acrylic resin described above, but, if it is difficult to prepare such a resin, a styrene-acrylic resin may also be used which has a glass transition temperature of 54.0° C.±1.0° C., a number-average molecular weight of 20,000±2,000 and a weight-average molecular weight of 200,000±20,000. Being within these ranges at least, substantially the same value is obtainable for the solubility in styrene-acrylic resin.

(6) Solubility of Ester Compound in Styrene Monomer

To 100 g of a styrene monomer kept at 40° C., the ester compound is added, and its dissolution level is found after these have been stirred for 3 hours.

An example of an image forming apparatus in which the toner of the present invention may favorably be used is specifically described below with reference to the FIGURE.

In the FIGURE, reference numeral 100 denotes a photosensitive drum, around which provided are a primary charging roller 117, a developing assembly 140 having a developing sleeve 102, a transfer charging roller 114, a cleaner 116, a registration roller 124 and so forth. The photosensitive drum 100 is electrostatically charged to, e.g., −600 V by means of the primary charging roller 117 (applied voltage: e.g., AC voltage of 1.85 kvpp and DC voltage of −620 Vdc). Then, the photosensitive drum 100 is exposed by irradiating it with laser light 123 by means of a laser generator 121, so that an electrostatic latent image is formed which corresponds to the intended image. The electrostatic latent image formed on the photosensitive drum 100 is developed with a one-component toner by means of the developing assembly 140 to form a toner image, and the toner image is transferred to a transfer material by means of the transfer roller 114 brought into contact with the photosensitive drum via the transfer material. The transfer material holding the toner image thereon is transported to a fixing assembly 126 by a transport belt 125, where the toner image is fixed onto the transfer material. Some toner left on the photosensitive drum is removed by the cleaning means 116 to clean the surface.

An image forming apparatus of magnetic one-component jumping development is shown here. However, the toner of the present invention may be either of a magnetic toner and a non-magnetic toner, and may be a toner used in any of a one-component development system and a two-component development system. It may further be a toner used in either method of jumping development and contact development.

EXAMPLES

The present invention is described below in greater detail by giving Examples and Comparative Examples, which, however, by no means limit the present invention. In the following formulation, "part(s)" refers to part(s) by mass in all occurrences.

Magnetic Powder Production Example

In an aqueous ferrous sulfate solution, 1.1 equivalent weight of a sodium hydroxide solution, based on iron element, $P_2O_5$ in an amount making 0.15% by mass in terms of phosphorus element, based on iron element, and $SiO_2$ in an amount making 0.50% by mass in terms of silicon element, based on iron element, were mixed to prepare an aqueous solution containing ferrous hydroxide. Keeping this aqueous solution to a pH of 8.0, air was blown into it, during which oxidation reaction was carried out at 85° C. to prepare a slurry having seed crystals.

Next, an aqueous ferrous sulfate solution was so added to this slurry as to be 1.1 equivalent weight based on the initial alkali quantity (sodium component of sodium hydroxide). Thereafter, the slurry was kept to a pH of 7.6, and air was blown into it, during which the oxidation reaction was allowed to proceed to obtain a slurry containing a magnetic iron oxide. This slurry was filtered and washed and thereafter this water-containing slurry was taken out first. At this point, this water-containing sample was collected in a small quantity to measure its water content previously. Then, without being dried, this water-containing sample was introduced into a different aqueous medium, and, with stirring and at the same time with circulation of the slurry, well re-dispersed by means of a pin mill, where the pH of the liquid re-dispersion was adjusted to about 4.8. Then, with stirring, n-hexyltrimethoxysilane was added thereto in an amount of 1.6 parts by mass (the quantity of the magnetic iron oxide was calculated as the value found when the water content was subtracted from the water-containing sample) based on 100 parts by mass of the magnetic iron oxide, to carry out hydrolysis. Thereafter, with thorough stirring and at the same time with circulation of the slurry, dispersion was carried out by means of a pin mill, and the pH of the liquid dispersion was adjusted to 8.6, where hydrophobic treatment was carried out. The hydrophobic magnetic powder thus formed was filtered with a filter press, and then washed sufficiently with a large quantity of water, followed by drying at 100° C. for 15 minutes and at 90° C. for 30 minutes. The resultant particles were subjected to disintegration treatment to obtain Magnetic Powder 1, having a volume average particle diameter (Dv) of 0.22 μm.

Production of Toner 1

Into 720 parts by mass of ion-exchanged water, 450 parts by mass of an aqueous 0.1 mol/liter $Na_3PO_4$ solution was introduced, followed by heating to 60° C. Thereafter, 67.7 parts by mass of an aqueous 1.0 mol/liter $CaCl_2$ solution was added thereto to obtain an aqueous medium containing a dispersion stabilizer.

| | |
|---|---|
| Styrene | 76.0 parts by mass |
| n-Butyl acrylate | 24.0 parts by mass |
| Divinylbenzene | 0.53 part by mass |
| Iron complex of monoazo dye (T-77, available from Hodogaya Chemical Co., Ltd.) | 1.0 parts by mass |
| Magnetic Powder 1 | 90.0 parts by mass |
| Saturated polyester resin | 5.0 parts by mass |

(saturated polyester resin obtained by condensation reaction of terephthalic acid with an ethylene oxide addition product of bisphenol A; Mn: 5,000; acid value: 12 mgKOH/g; Tg: 68° C.)

Materials formulated as shown above were uniformly dispersed and mixed by means of an attritor (manufactured by Mitsui Miike Engineering Corporation). The monomer composition thus obtained was heated to 60° C., and 15 parts by mass of a paraffin wax (melting point: 74.0° C.; solubility in styrene-acrylic resin: 2.6%) and 10 parts by mass of a behenic ester of dipentaerythritol (hereinafter denoted "DP-622"; its physical properties are shown in Table 1) were added thereto and mixed to dissolve it. Thereafter, 4.5 parts by mass of a polymerization initiator 2,2'-azobis(2,4-dimethylvaleronitrile) was dissolved to prepare a polymerizable monomer composition.

The polymerizable monomer composition was introduced into the above aqueous medium, followed by stirring for 10 minutes at 60° C. in an atmosphere of $N_2$, using TK type homomixer (manufactured by Tokushu Kika Kogyo Co., Ltd.) at 12,000 rpm to carry out granulation. Thereafter, the granulated product obtained was stirred with a paddle stirring blade, during which the reaction was carried out at 70° C. for 5 hours. After the reaction was completed, the suspension formed was cooled, and hydrochloric acid was added thereto to effect washing, followed by filtration and then drying to obtain Toner Particles 1.

100 parts by mass of this Toner Particles 1 and 1.0 part by mass of hydrophobic silica of 12 nm in number average primary particle diameter were mixed by means of Henschel mixer (manufactured by Mitsui Miike Engineering Corporation) to obtain Toner 1, having a weight average particle diameter (D4) of 7.5 μm. Physical properties of Toner 1 are shown in Table 2.

Production of Toner 2

Toner 2 was obtained in the same way as that in Production of Toner 1 except that, in Production of Toner 1, the behenic ester of dipentaerythritol was changed for an arachidic ester of dipentaerythritol (hereinafter denoted "DP-620"; its physical properties are shown in Table 1). Physical properties of Toner 2 are shown in Table 2.

Production of Toner 3

Toner 3 was obtained in the same way as that in Production of Toner 1 except that, in Production of Toner 1, the behenic ester of dipentaerythritol was changed for a stearic ester of dipentaerythritol (hereinafter denoted "DP-618"; its physical properties are shown in Table 1). Physical properties of Toner 3 are shown in Table 2.

Production of Toner 4

Toner 4 was obtained in the same way as that in Production of Toner 1 except that, in Production of Toner 1, the paraffin wax having a melting point of 74.0° C. was changed for a paraffin wax having a melting point of 83.1° C. (solubility in styrene-acrylic resin: 5.6%). Physical properties of Toner 4 are shown in Table 2.

Production of Toner 5

Toner 5 was obtained in the same way as that in Production of Toner 1 except that, in Production of Toner 1, the paraffin wax having a melting point of 74.0° C. was changed for a paraffin wax having a melting point of 64.2° C. (solubility in styrene-acrylic resin: 20.3%). Physical properties of Toner 5 are shown in Table 2.

Production of Toner 6

Toner 6 was obtained in the same way as that in Production of Toner 1 except that, in Production of Toner 1, the paraffin wax having a melting point of 74.0° C. was changed for a paraffin wax having a melting point of 87.2° C. (solubility in styrene-acrylic resin: 5.1%). Physical properties of Toner 6 are shown in Table 2.

Production of Toner 7

Toner 7 was obtained in the same way as that in Production of Toner 1 except that, in Production of Toner 1, the amount 10 parts by mass of the behenic ester of dipentaerythritol was changed to 2.0 parts by mass. Physical properties of Toner 7 are shown in Table 2.

Production of Toner 8

Toner 8 was obtained in the same way as that in Production of Toner 1 except that, in Production of Toner 1, the amount 10 parts by mass of the behenic ester of dipentaerythritol was changed to 21.0 parts by mass. Physical properties of Toner 8 are shown in Table 2.

Production of Toner 9

Toner 9 was obtained in the same way as that in Production of Toner 1 except that, in Production of Toner 1, the amount 15 parts by mass of the paraffin wax having a melting point of 74.0° C. was changed to 10 parts by mass. Physical properties of Toner 9 are shown in Table 2.

Production of Toner 10

Toner 10 was obtained in the same way as that in Production of Toner 1 except that, in Production of Toner 1, the amount 15 parts by mass of the paraffin wax having a melting point of 74.0° C. was changed to 31 parts by mass. Physical properties of Toner 10 are shown in Table 2.

Production of Toner 11

Toner 11 was obtained in the same way as that in Production of Toner 1 except that, in Production of Toner 1, the amount 0.53 part by mass of the divinylbenzene was changed to 0.10 part by mass. Physical properties of Toner 11 are shown in Table 2.

Production of Toner 12

Toner 12 was obtained in the same way as that in Production of Toner 1 except that, in Production of Toner 1, the amount 0.53 part by mass of the divinylbenzene was changed to 1.20 parts by mass. Physical properties of Toner 12 are shown in Table 2.

Production of Toner 13

Toner 13 was obtained in the same way as that in Production of Toner 1 except that, in Production of Toner 1, the behenic ester of dipentaerythritol was not used. Physical properties of Toner 13 are shown in Table 2.

Production of Toner 14

Toner 14 was obtained in the same way as that in Production of Toner 1 except that, in Production of Toner 1, the paraffin wax having a melting point of 74.0° C. was not used. Physical properties of Toner 14 are shown in Table 2.

Production of Toner 15

Toner 15 was obtained in the same way as that in Production of Toner 1 except that, in Production of Toner 1, the behenic ester of dipentaerythritol was changed for a palmitic ester of dipentaerythritol (hereinafter denoted "DP-616"; its physical properties are shown in Table 1). Physical properties of Toner 15 are shown in Table 2.

Production of Toner 16

Toner 16 was obtained in the same way as that in Production of Toner 1 except that, in Production of Toner 1, the behenic ester of dipentaerythritol was changed for a cerotic ester of dipentaerythritol (hereinafter denoted "DP-626"; its physical properties are shown in Table 1). Physical properties of Toner 16 are shown in Table 2.

Production of Toner 17

Toner 17 was obtained in the same way as that in Production of Toner 1 except that, in Production of Toner 1, the behenic ester of dipentaerythritol was changed for a stearic ester of pentaerythritol (hereinafter denoted "PE-418"; its physical properties are shown in Table 1). Physical properties of Toner 17 are shown in Table 2.

Production of Toner 18

Toner 18 was obtained in the same way as that in Production of Toner 1 except that, in Production of Toner 1, the behenic ester of dipentaerythritol was changed for hexaglycerol tetrastearate tetrabehenate (hereinafter denoted "HG-418"; its physical properties are shown in Table 1). Physical properties of Toner 18 are shown in Table 2.

Production of Toner 19

Toner 19 was obtained in the same way as that in Production of Toner 1 except that, in Production of Toner 1, the paraffin wax having a melting point of 74.0° C. was changed for Fischer-Tropsch wax having a melting point of 92.0° C. (solubility in styrene-acrylic resin: 3.8%). Physical properties of Toner 19 are shown in Table 2.

TABLE 1

Physical Properties of Ester Compound

| Ester compound | Carboxylic acid, number of carbon atoms | Melting point | Solubility in styrene = acrylic resin | Solubility in styrene monomer |
|---|---|---|---|---|
| DP-622 | 22 | 83° C. | 0.5% | <5.0% |
| DP-620 | 20 | 79° C. | 1.2% | <5.0% |
| DP-618 | 18 | 75° C. | 2.1% | <5.0% |
| DP-616 | 16 | 69° C. | 2.8% | >5.0% |
| DP-626 | 26 | 92° C. | 0.1% | <5.0% |
| PE-418 | 18 | 76° C. | 4.2% | >5.0% |
| HG-418 | 18 | 64° C. | 8.3% | >5.0% |

TABLE 2

Physical Properties of Toner

| Toner No. | Average particle diameter | Average circularity | THF-insoluble matter |
|---|---|---|---|
| 1 | 7.5 μm | 0.971 | 33% |
| 2 | 7.3 μm | 0.972 | 30% |
| 3 | 7.2 μm | 0.972 | 34% |
| 4 | 7.8 μm | 0.970 | 32% |
| 5 | 7.1 μm | 0.972 | 31% |
| 6 | 7.8 μm | 0.969 | 35% |
| 7 | 7.1 μm | 0.973 | 37% |
| 8 | 7.9 μm | 0.969 | 30% |
| 9 | 7.5 μm | 0.971 | 33% |
| 10 | 7.8 μm | 0.968 | 31% |
| 11 | 7.6 μm | 0.971 | 4% |
| 12 | 7.4 μm | 0.971 | 66% |
| 13 | 7.2 μm | 0.972 | 36% |
| 14 | 7.3 μm | 0.973 | 29% |
| 15 | 7.3 μm | 0.971 | 36% |
| 16 | 7.9 μm | 0.968 | 35% |
| 17 | 7.5 μm | 0.972 | 33% |
| 18 | 7.3 μm | 0.972 | 31% |
| 19 | 7.9 μm | 0.967 | 36% |

Example 1

Image Forming Apparatus

Using LBP-3410 (manufactured by CANON INC.; 33 sheets/minute in A4-lengthwise paper feed) as an image forming apparatus and using Toner 1, horizontal-line images having a print percentage of 4% were reproduced on 6,000 sheets in a continuous mode to conduct a running test in an environment of normal temperature and normal humidity (23° C./60% RH). A4-size 75 g/m$^2$ sheets of paper were used as recording mediums. As the result, neither ghost nor fog occurred before and after the running test, and images with a high density were obtainable. Evaluation results are shown in Table 3.

A fixing test was also conducted in the following way.

Extra 80 g sheets of paper were used as recording mediums, and development bias was so set that halftone images were formed in an image density of from 0.60 to 0.65. Then, the fixing assembly was cooled to room temperature, and heater temperature of the fixing assembly was set (hereinafter "fixing temperature"), where, 6 seconds after electrification, a sheet with toner images was passed through the fixing assembly to perform fixing. Thereafter, fixed images were rubbed 10 times with Silbon paper under application of a load of 50 g/cm$^2$, where the rate of decrease in image density before and after the rubbing came to 10% was regarded as fixing start temperature. Also, on A4-size 75 g/m$^2$ paper, solid toner images were so formed as to be 0.6 mg/cm$^2$ in toner mass per unit area, and the temperature at which offset occurred at high temperature was examined, changing the temperature of the fixing assembly variously. High-temperature offset was observed by visually judging the fixed images on paper, and the highest temperature at which any high-temperature offset did not occur (i.e., fixing end temperature) was examined. As the result, the magnetic, Toner 1 was found to have a fixing start temperature of 180° C. and a fixing end temperature of 240° C.

Methods for evaluation and judgment criteria therefor are described below on evaluations made in Examples and Comparative Examples of the present invention.

Image Density

To evaluate image density, solid images were formed, and the density of the solid images thus formed was measured with Macbeth densitometer (manufactured by Gretag Macbeth Ag).

Fog

White images were reproduced, and the reflectance of the images formed was measured with REFLECTOMETER MODEL TC-6DS, manufactured by Tokyo Denshoku Co., Ltd. Meanwhile, the reflectance was also measured in the same way on a transfer sheet (reference sheet) before the white images were formed thereon. A green filter was used as a filter. From the values of reflectance before and after the white-image reproduction, fog was calculated according to the following expression.

Fog(reflectance)(%)=[reflectance(%) of reference sheet]−[reflectance (%) of white-image sample].

Evaluation criteria of the fog are as follows:

A: Very good (less than 1.5%).

B: Good (from 1.5% or more to less than 2.5%).

C: Average (from 2.5% or more to less than 4.0%).

D: Poor (4.0% or more).

Examples 2 to 12

The image reproduction running test and fixing text were conducted in the same way as those in Example 1 except that Toners 2 to 12 were used, respectively. As the result, all the toners enabled formation of images which were at least at a level of no problem in practical use before and after the running test, and showed good fixing performance. Evaluation results are shown in Table 3.

Comparative Examples 1 to 7

The image reproduction running test and fixing text were conducted in the same way as those in Example 1 except that Toners 13 to 19 were used, respectively. As the result, all the toners showed a fixing temperature of higher than 200° C., resulting in an unsatisfactory fixing performance. Also, Toners 16 and 18 caused fog at a serious level after the running test, presumably because of poor dispersibility of the ester compound. Evaluation results are shown in Table 3.

TABLE 3

Test Results of Image Reproduction in Low-temperature and Low-humidity Environment, and Fixing Test Results

| | | Initial stage | | After running | | Fixing start | Fixing end |
|---|---|---|---|---|---|---|---|
| | Toner | Image density | Fog | Image density | Fog | temp. (° C.) | temp. (° C.) |
| Example: | | | | | | | |
| 1 | 1 | 1.53 | A | 1.51 | A | 180 | 240 |
| 2 | 2 | 1.52 | A | 1.50 | A | 185 | 240 |
| 3 | 3 | 1.49 | A | 1.46 | B | 190 | 240 |
| 4 | 4 | 1.50 | A | 1.47 | B | 190 | 240 |
| 5 | 5 | 1.47 | B | 1.42 | B | 185 | 240 |
| 6 | 6 | 1.49 | A | 1.46 | B | 195 | 245 |
| 7 | 7 | 1.54 | A | 1.52 | A | 195 | 240 |
| 8 | 8 | 1.45 | B | 1.39 | B | 180 | 240 |
| 9 | 9 | 1.53 | A | 1.52 | A | 195 | 240 |
| 10 | 10 | 1.44 | B | 1.39 | C | 180 | 240 |
| 11 | 11 | 1.51 | A | 1.31 | C | 180 | 200 |
| 12 | 12 | 1.53 | A | 1.53 | A | 195 | 250 |
| Comparative Example: | | | | | | | |
| 1 | 13 | 1.52 | A | 1.48 | A | 210 | 240 |
| 2 | 14 | 1.53 | A | 1.52 | A | 220 | 240 |
| 3 | 15 | 1.48 | A | 1.41 | B | 205 | 240 |
| 4 | 16 | 1.41 | B | 1.32 | D | 200 | 240 |
| 5 | 17 | 1.38 | B | 1.34 | C | 205 | 240 |
| 6 | 18 | 1.35 | B | 1.28 | D | 210 | 240 |
| 7 | 19 | 1.37 | B | 1.32 | C | 205 | 240 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2008-139237, filed on May 28, 2008, which is herein incorporated by reference as part of this application.

What is claimed is:

1. A toner which comprises toner particles containing at least a binder resin, a colorant, an ester compound and a low melting material;

the ester compound being an ester of dipentaerythritol with a carboxylic acid having 18 or more to 25 or less carbon atoms;

where the melting point of the ester compound is represented by $Tm_{(A)}$(° C.) and the melting point of the low melting material is represented by $Tm_{(B)}$(° C.), the toner satisfying the relationship of:

$$Tm_{(B)}<Tm_{(A)};$$

wherein the ester compound has a solubility S(A) in a styrene acrylic resin, of 2.5% or less, the styrene-acrylic resin has a glass transition temperature of 54.0° C.±1.0° C., a number-average molecular weight of 20,000±2,000 and a weight average molecular weight of 200,000±20,000; and wherein the low melting material has a solubility S(B) in the styrene acrylic resin, of from 5.5% or more to 20.0% or less, and S(A)<S(B).

2. The toner according to claim 1, wherein the ester compound has a solubility S(A) in a styrene acrylic resin, of 2.0% or less.

3. The toner according to claim 1, wherein the ester compound has a solubility in a styrene monomer at 40° C., of less than 5.0% by mass.

4. The toner according to claim 1, wherein the toner particles contain the ester compound in an amount of from 3.0 parts by mass or more to 20.0 parts by mass or less, based on 100 parts by mass of the binder resin.

5. The toner according to claim 1, wherein the low melting material is in a content from 1.2 times or more to 3.0 times or less the content of the ester compound by mass.

6. The toner according to claim 1, wherein the ester compound has a melting point of from 70° C. or more to 90° C. or less.

7. The toner according to claim 1, which has an average circularity of 0.950 or more.

8. The toner according to claim 1, wherein a binder resin component of the toner has THF-insoluble matter in a content of from 5.0% by mass or more to 65.0% by mass or less.

* * * * *